United States Patent [19]

Dodge et al.

[11] Patent Number: 4,635,049

[45] Date of Patent: Jan. 6, 1987

[54] APPARATUS FOR PRESENTING IMAGE INFORMATION FOR DISPLAY GRAPHICALLY

[75] Inventors: Warren Dodge, Portland; Rebecca Wirfs-Brock, Sherwood, both of Oreg.

[73] Assignee: Tektronix, Inc., Beaverton, Oreg.

[21] Appl. No.: 624,890

[22] Filed: Jun. 27, 1984

[51] Int. Cl.[4] ..... G09G 1/06

[52] U.S. Cl. ..... 340/721; 340/703; 340/747; 340/801

[58] Field of Search ..... 340/703, 721, 729, 747, 340/789, 798, 801

[56] References Cited

U.S. PATENT DOCUMENTS

| | | | |
|---|---|---|---|
| 4,426,644 | 1/1984 | Neuman et al. | 340/747 |
| 4,509,043 | 4/1985 | Mossaides | 340/703 |
| 4,559,553 | 12/1985 | Bass et al. | 340/747 |

*Primary Examiner*—John W. Caldwell, Sr.
*Assistant Examiner*—Jeffery A. Brier
*Attorney, Agent, or Firm*—John P. Dellett; Allston L. Jones; Robert S. Hulse

[57] ABSTRACT

Pixel information for a graphics display apparatus is stored in a bit map memory which may be considered as grouped into a number of bit planes corresponding to different separable surfaces or color patterns to be displayed by the apparatus. Information from a computer data bus is written into the proper surface by shifting a predetermined number of bit positions and write protecting information in the bit map memory representing surfaces other than the one it is desired to change.

6 Claims, 9 Drawing Figures

APPARATUS FOR PRESENTING IMAGE INFORMATION FOR DISPLAY GRAPHICALLY

BACKGROUND OF THE INVENTION

The present invention relates to a graphics display apparatus and particularly to such apparatus for selectively displaying one or more of a plurality of images that are input to the apparatus from common based computer input data.

A prior art graphics display system, such a described in U.S. Pat. No. 4,509,043, entitled METHOD AND APPARATUS FOR DISPLAYING IMAGES issued on Apr. 2, 1985, to Paula X. Mossaides and assigned to Tektronix, Inc., is capable of simultaneously or selectively portraying a number of different views on the same screen. For instance, the display apparatus may simultaneously display superimposed views of an automobile chassis, an automobile body, and an automobile steering column mechanism, or these views may be presented separately. Another example comprises the layout for a circuit board where the component parts and the wiring may be viewed separately or in properly superimposed relation. The various images are usually presented in different colors, or in different groups of colors, so that the separate portions of the structure may be identified even when a composite view is being presented.

The display apparatus ordinarily employs a color cathode-ray-tube capable of producing any number of different colors but operated in a given instance to display a small number of distinct colors identified with the various selectable images. Thus, an automobile body may be displayed in blue and green, while the chassis may be displayed in red and yellow.

The display is generated from a "pixel bit map" memory which at a given instant stores the color or colors of each pixel or each elementary part of the picture which is to be displayed by the cathode-ray-tube. Inputting to this pixel bit map memory is conveniently provided from the data bus of a computer wherein each pixel of the display is calculated or presented from "high level" data in the computer's memory. Thus, the computer's memory may store the line segments representing an automobile body as a plurality of vector lines, but this information is converted into pixels by the computer for storage in the aforementioned pixel bit map memory so that the pixel bit map memory may be scanned in normal raster fashion in order to present a TV-like display.

The input information from the computer to the pixel bit map memory suitably comprises a four-bit word representative of a given pixel and capable of defining sixteen different colors for that pixel, i.e. represented by the binary digits 0000 through 1111. Let us assume the word 0000 represents the absence of any information at the pixel point, while the binary number 0001 represents the color red, etc. Obviously any combination of sixteen colors can be identified by the four-bit word, including, of course, one identified for the total absence of a pixel. The scheme as thus far described would be capable of portraying one image in sixteen different colors.

For the purpose of presenting a plurality of different or separable images, the concept of separate "surfaces" comes into play, wherein one "surface" represents the automobile body, another "surface" represents the automobile chassis, etc. The body surface may be represented only in colors red and green, the chassis only in red and yellow, etc. In order to identify different surfaces, the four-bit word stored at each pixel location in the pixel map memory may be considered as divided into a number of subwords of a lesser number of bits. For instance, the pixel word stored for the pixel at the upper lefthand corner of the screen may include two lower order bits representing one surface, and two higher order bits representing another surface. In such case, the two lower order bits are capable of designating four colors by their various combinations, and the two higher order bits are capable of designating four (presumably different) colors by their combinations. Alternatively, with four bits in each pixel storage location, it is possible to designate four surfaces, one for each of the four bits. Other combinations are also possible.

For the eventual display, a color translator or color bit map comprising a separate memory is utilized to translate the stored indices for each pixel in the pixel bit map memory to the desired colors, and also to selectively show only one or more designated surfaces as desired.

A problem is presented in the prior art, however, when common based input data is employed to write to different surfaces. Thus, one input word may be received from the computer for writing to the red and green "surface" of the automobile body, while another word may be received which is to write information to the "surface" representing the automobile chassis. Both words are input on a common data bus and each is identically based, i.e. with the lowest ordered bit on the lowest ordered data bus conductor. Heretofore, it has been necessary when inputting certain patterns, vectors, shaded areas and the like, to require the computer to shift the input data or index a desired number of places in order to "write to" the proper "surface" in the pixel bit map memory. This shifting would frequently have to be accomplished for each data word, under the control of the computer software, thereby consuming excessive amounts of time in writing the desired information.

SUMMARY OF THE INVENTION

In accordance with the present invention in its illustrated embodiment, the computer input data on a computer data bus is shifted by a gate structure the proper number of places for writing into a designated "surface" in pixel bit map memory. In addition, information in pixel bit map memory representing other "surfaces" to which no information is to be written is write protected through reading information from the pixel bit map memory and writing the same information back into the pixel bit map memory in place of shifted data. Thus, the shifted data will reach only the "surface" in memory for which it is intended without disturbing information representing other "surfaces". A particular "surface" to which data is to be written is designated at a particular time and the gating structure is operated to provide the proper shift without requiring constant shifting of information in the processor thereby saving considerable time in execution.

It is accordingly an object of the present invention to enable the writing of computer bus information directly to a pixel bit map memory in a graphics display unit without necessitating constant shifting of data by the processor in order to write to the proper surface.

It is another object of the present invention to provide an improved graphics display apparatus which is fast in operation and responsive to pixel information from a computer data bus wherein said information is representative of different surfaces in the display.

The subject matter of the present invention is particularly pointed out and distinctly claimed in the concluding portion of the specification. However, both the organization and method of operation, together with further advantages and objects thereof, may best be understood by reference to the following description taken in connection with the accompanying drawings wherein like reference characters refer to like elements.

DRAWINGS

FIG. 1 is a block diagram illustrating the generation of graphics surfaces employing a color map memory, FIG. 2 is a schematic illustration of plural "memory planes" representing a pixel bit map memory of the presenst invention, FIG. 3 is an explanatory drawing for illustrating possible contents of the aforementioned color map memory, FIG. 4 is a block diagram of circuitry according to the present invention, FIG. 5 is a block diagram further illustrating a pixel bit map memory portion of the FIG. 4 circuitry, FIG. 6 is a block diagram of gating structure according to the present invention for shifting input data, FIG. 7 is a block diagram of a latching circuitry according to the present invention, FIG. 8 is a state diagram illustrating timing of the FIG. 4 circuitry, and FIG. 9 is a cycle chart further illustrating operation of the FIG. 4 circuitry.

DETAILED DESCRIPTION

Figure 1:
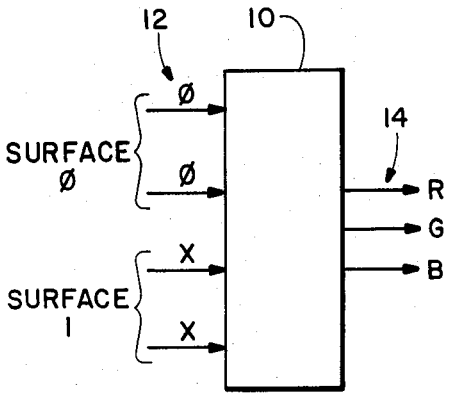
Figure 2:
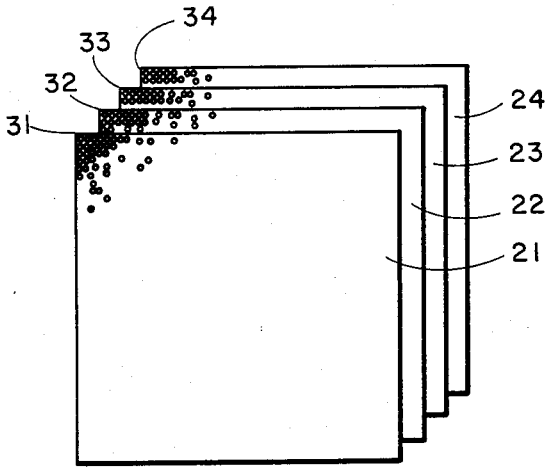
Figure 4:
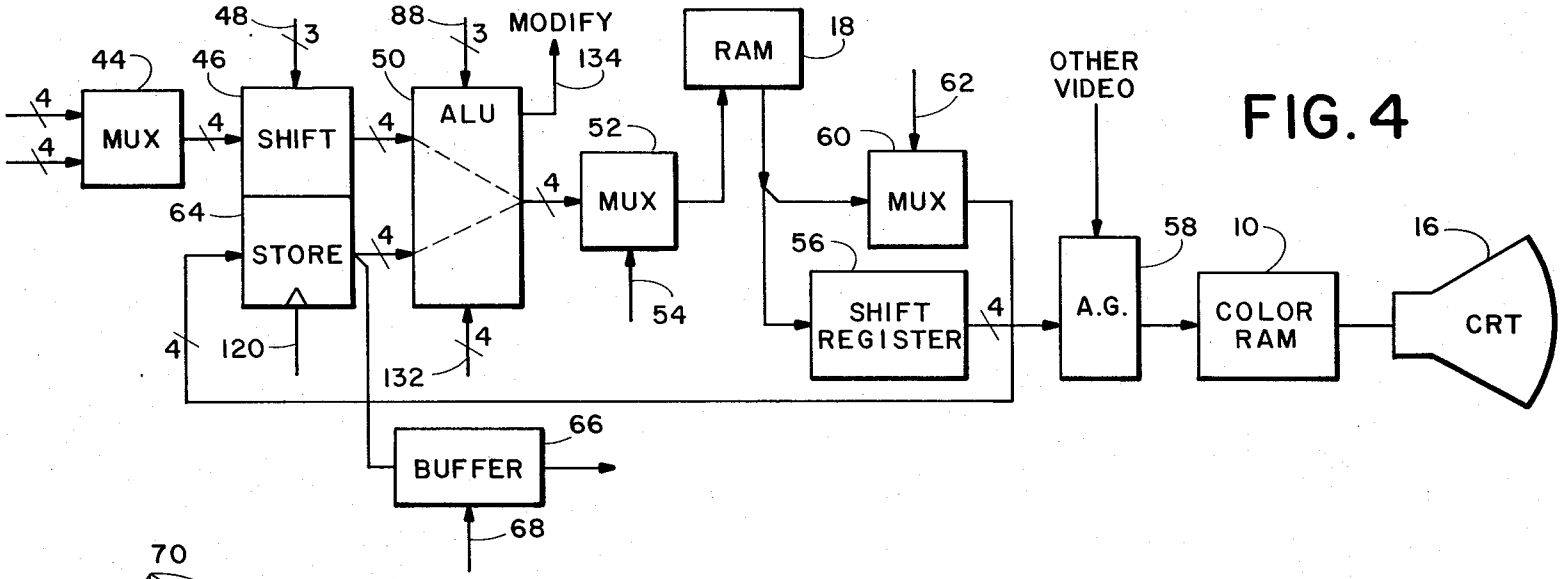

Referring to FIG. 1, graphics display apparatus according to the present invention suitably includes a color map memory 10 receiving digital input data 12 and outputting, via an internal digital to analog converter, the red, green and blue signals for operating cathode-ray-tube 16 (FIG. 4). The digital data 12 comprises a four bit word derived from a pixel bit map memory 18 further discussed in connection with FIG. 4 and also depicted in schematic fashion in FIG. 2. The pixel bit map memory suitably stores pixel information in what may be thought of as four bit planes, 21, 22, 23 and 24, wherein each bit plane stores one of the bits of each data word 12. Considering a one-to-one correspondence between the pixel bit map memory and the face of the cathode-ray-tube, a pixel i.e. the smallest nondivisible element of the picture, for example presented at the upper lefthand corner of the screen, is represented by pixel bits 31, 32, 33 and 34 stored in bit planes 21, 22, 23 and 24 respectively. The four pixel bits 31–34 are presented as the data word 12 to color map memory 10 which translates the four bit word into sixteen different possible color identifying words stored in memory 10, as further discussed in the aforementioned U.S. Pat. No. 4,509,043. The graphics display apparatus suitably sequences through all the pixels stored in memory 18 by rows, presenting each as a word 12 to memory 10, and then repeats the operation for persistence of display on the cathode-ray-tube.

As mentioned, the word 12, having four digits, is capable of identifying sixteen different colors, the designations of which are stored in color map memory 10. That is, color map memory 10 identifies which sixteen colors it may be desired to display and color map memory 10 can be altered to identify any sixteen colors the equipment is capable of producing.

It is desired to represent a plurality of different images for the cathode-ray-tube display that may be viewed separately or in superposition, for example the images of an automobile body and automobile chassis. In this case, the input word 12 to the color map memory 10 is divided, for example as in the FIG. 1 illustration, into surface 0 and surface 1. In such case, each surface has two digits available and therefore four colors can be selected for each of the two different surfaces, with these colors presumably being different so that the surfaces can be distinguished when shown superimposed on the cathode-ray-tube screen.

Figure 3:
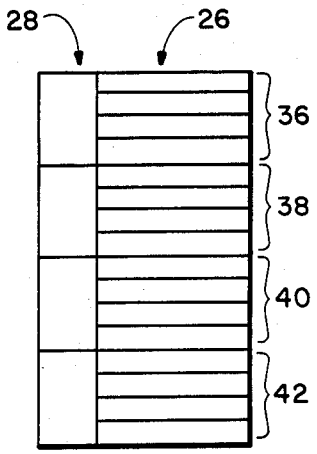

When it is desired to display only one of the surfaces, for example surface 0 in FIG. 1, the color map 10 is configured by the computer so that it makes no difference what the digits for surface 1 would imply. Thus, assuming surface 0 is to be viewed at a certain time and surface 1 is not to be viewed, the color map memory 10 may be configured as may be explained with the aid of FIG. 3, showing sixteen memory locations at 26. The memory locations are filled with repetitive data at 36, 38, 40 and 42 so that no matter what the higher order bits representative of surface 1, indicated at 28, may be, the color map will only be responsive to the input for surface 0. Since a given surface or combination of surfaces will be viewed for some considerable time, comparatively little overhead time is involved in reconfiguring color map memory 10 so that only the desired information is viewed.

The present invention is concerned with the inputting of data to the pixel map memory 18 from the data bus of a computer, e.g. for writing the information into the pixel map memory and for adding or changing information in the pixel map memory. For convenience, the pixel map memory will be considered as divided into memory groups storing different pixel maps for different surfaces (i.e. colors or combinations of colors). It is desired to enable the computer to selectively write into a particular pixel map without interfering with information which may be stored in other pixel maps.

Referring to FIG. 4, multiplexer 44 receives input data from the data bus of a computer or processor, for example a type 80186 processor manufactured by Intel Corporation. The data bus in this case is 16 bits wide and for purposes of the FIG. 4 circuitry, each eight bit byte represents a pixel of which only four bits are actually employed by the present circuitry. The multiplexer 44 selectively chooses the "high" four bits or the "low" four bits as input from the computer data bus. The four bit output of multiplexer 44 is provided to shift means 46 which is controlled by a three-bit signal 48 designating whether a shift is to be performed as hereinafter more fully described. The four bit output of shift circuitry 46 is coupled to ALU (arithmetic logic unit) 50 wherein certain modifications may be performed on the four bit word as also hereinafter more fully described. The output of ALU 50 is coupled to pixel bit map memory 18 via 1:16 multiplexer 52 under the control of an address 54. Memory 18 is repetitively read out by way of shift register 56 for providing continuous input to color map memory 10 in the manner hereinbefore described by way of attributes gating 58 wherein other video information can be added. The shift register 56 permits reading out of memory 18 in a parallel mode, sixteen four bit pixel words at a time, which are sequentially input to color memory 10.

Alternatively, memory 18 can be read out one four bit word at a time via 16:1 multiplexer 60 to storage means 64. As hereinafter more fully described, the data from storage means 64 can then be provided via buffer 66 as an input signal to the data bus of the processor, or can be utilized by ALU 50 for writing modified information back into memory 18. For instance, if it is desired to combine "new" information from the computer data bus with "old" information theretofore stored in memory 18, storage means 64 is first loaded from memory 18, and then the stored information may be logically combined with new information from shift means 46 in ALU 50 for reentry into memory 18.

Figure 5:
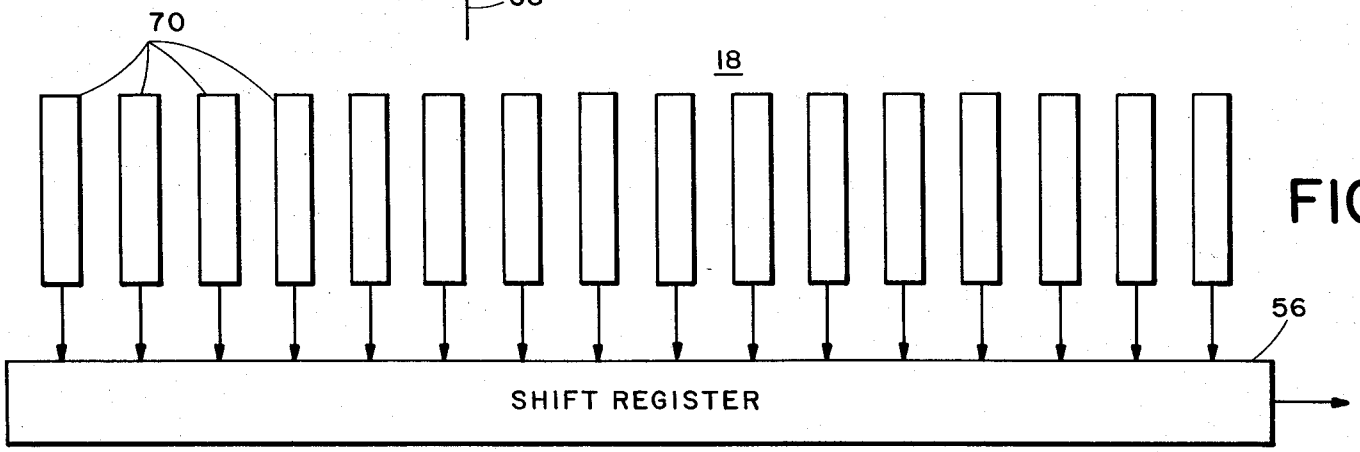

FIG. 5 illustrates pixel bit map memory 18 in relation to shift register 56. Memory 18 comprises sixteen random access memories 70 wherein each of the random access memories 70 in the illustrated example is a 16K×4 RAM and wherein each random access memory stores 16K of four bit words to provide pixel identifications sent to color map memory 10. In the actual embodiment, a first set of sixteen 16K×4 RAMs is employed to define the pixels for the top half of the CRT screen while a second set of sixteen 16K×4 RAMs is employed for the bottom half of the screen, for an effective total of sixteen 32K×4 random access memories. For reading out data to the cathode-ray-tube screen, a four bit word representing a separate pixel, is read from each of the random access memories 70 in parallel to shift register 56, the latter being four deep, i.e. comprising four single bit sequence shift registers. The circuitry of FIG. 4 is operated on a processor-display interleave basis so that for half the time (320 nanoseconds) the random access memories are read out for input to shift register 56, while during the remaining or interleave time (320 nanoseconds) data can be input into the memory 18 or read out from memory 18 for input to the processor. During the total period of 640 nanoseconds, the pixel data is serially read out from shift register 56. The memory 18 has the capability of a 1024×512 bit map, but in a specific embodiment only 640×480 pixels are displayed on the screen.

Figure 9:
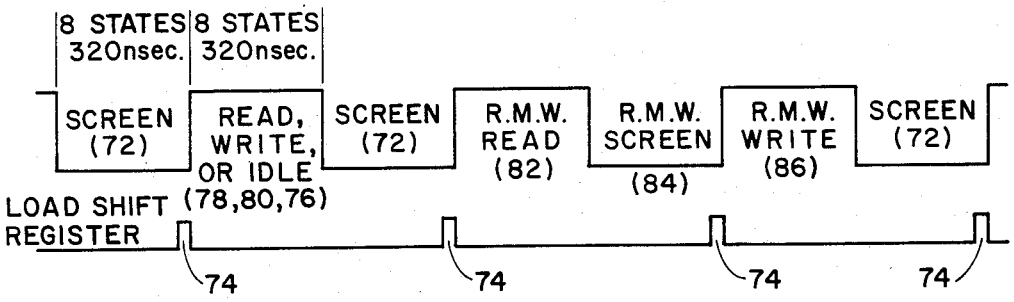
Figure 8:
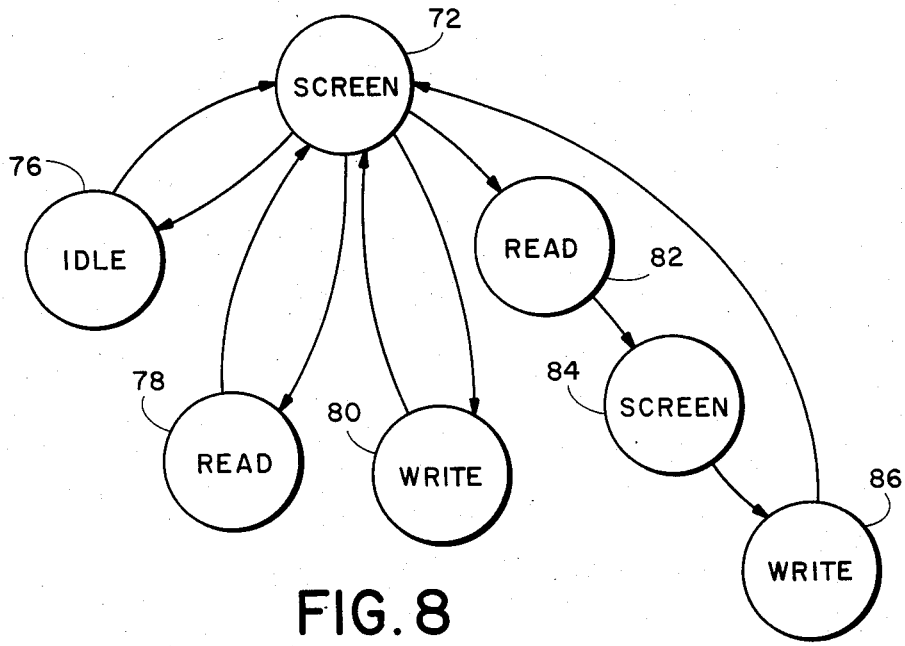

The timing of operations will be more clearly understood from consideration of the state diagram of FIG. 8 and the cycle chart of FIG. 9 which describe the operation of the FIG. 4 circuit in greater detail. The operation of the circuitry is divided into sixteen forty nanosecond states (corresponding to sixteen clock periods) to provide an overall time period of 640 nanoseconds. During an eight state screen cycle 72 in FIG. 8, data from memory 18 is accessed in parallel from random access memories 70 for input of sixteen pixels to shift register 56. At the end of every screen cycle a load shift register pulse 74 is provided as illustrated in FIG. 9, and then for the following 640 nanoseconds the pixel information is shifted out of shift register 56 to the color map memory 10 via attributes gating circuit 58. Assuming pixel information is merely being read from the memory 18 and into color map memory 10 for display on the cathode-ray-tube, and no information is to be changed, read into, or read out of the pixel map memory 18 to the processor, then screen cycle 72 in FIG. 8 is succeeded by an eight state idle cycle 76 for consuming 320 nanoseconds until the start of the next screen cycle. This idle cycle takes place during the "interleave" portion of the operation, assuming no processor activity with respect to the pixel bit map memory at this time.

On the other hand, if the processor wishes to read information from the pixel bit map memory, circuit paths are energized between memory 18 and buffer 66, i.e. via muliplexer 60 and storage means 64, during a read cycle 78 in FIG. 8. The four bit word from memory 18 is supplied to storage means 64, the latter comprising four latches 115–118 (FIG. 7), during the read cycle 78, and when the processor wishes to read this data it does so by energizing a graphics read enable signal 68 applied to buffer 66. An appropriate address for the memory to be read out is applied to 16:1 multiplexer 60 at address input 62, as well as to the random access memories themselves.

For a write of new information into the pixel bit map memory, an eight state write cycle 80 is interleaved with screen cycle 72. As indicated at the lefthand side of FIG. 9, the write cycle, like the idle and read cycle, consumes 320 nanoseconds. During this time the input from the processor data bus via multiplexer 44, shift means 46, ALU 50 and multiplexer 52 is applied to pixel bit map memory 18. The 1:16 multiplexer 52 provides the input to the correct random access memory 70 which is also addressed from the processor via its address bus (not shown). As hereinafter more fully described, the data from the processor data bus is either read directly into the pixel memory, or in a shifted position, to reach the correct surface or image it is desired to write to or alter.

During a read-modify-write sequence illustrated at the righthand side of FIG. 8, information is first read from pixel bit map memory in a read cycle 82 with the data from the addressed location in memory being stored in storage means 64 as in the case of the read cycle hereinbefore described. Read cycle 82 requires 320 nanoseconds. Although the read-modify-write sequence is not completed at this time, nevertheless a screen cycle 84 is interposed between read cycle 82 and write cycle 86 in FIG. 8 to provide a constant flow of pixel information to color map memory 10. The screen cycle 84, like the screen cycle 72, requires 320 nanoseconds during which time information for sixteen pixels from random access memories 70 is read for input into shift register 56 in FIG. 5. After screen cycle 84, a 320 nanosecond write cycle 86 takes place during which information from storage means 64 and/or shift means 46 is read into pixel bit map memory 18 by way of ALU 50 and multiplexer 52. The ALU 50 may combine "new" data from multiplexer 52 with "old" data from storage means 64 in one of several ways. In one mode of operation, the old information from storage means 64 is simply ignored and new information from shift means 46 is read into memory 18. In another mode of operation, indicated as the write protect mode as hereinafter more fully described, the reverse action in part takes place wherein new data is partially ignored and old data from storage means 64 is read into memory. Other logical operations for combining the new and old data are AND, OR, and XOR (exclusive OR), with the indicated combinations of new and old data being provided. ALU 50 suitably comprises a type 20L8 "PAL" (Programmable Array Logic Circuit) manufactured by Monolithic Memories, Inc. The control of ALU 50 for various logical combinations of applied information is brought about by three control lines 88 in FIG. 4. The read-modify-write cycle is further indicated at 82, 84, 86 in FIG. 9.

The logical operations performed by ALU 50 are useful in various ways for combining the "new" and "old" data. For instance, if a certain configuration or pattern has been stored in the pixel bit map memory 18, such as a rectangle, the same configuration may be removed from the pixel bit map memory by inputting the same pattern to the same location in the pixel bit map memory employing the read-modify-write cycle with the ALU 50 in the exclusive OR mode. The configuration or pattern is removed and other "underlying" information will be visible.

Between the ends of screen cycles, depicted at 72 and 84 in FIG. 8, the "strip" of graphic pixels is shifted in shift register 56 to color map memory 10 and ultimately to the CRT screen. Thus, sixteen clock periods are required to display the strip of graphics on the screen. During eight of those clock periods, the processor has a chance to read or write information with respect to the pixel bit map memory 18, and during the other eight clock periods or during a screen cycle, sixteen bits from random access memory 70 are accessed for loading into the shift register 56. At the end of each screen cycle a reload pulse is applied to the shift register.

As hereinbefore mentioned, it is convenient to consider the pixel data in pixel bit map memory 18 as being divided into plural pixel bit maps representing separate "surfaces", wherein the term "surface" refers to a drawing or representation in one or more colors which can be displayed simultaneously with, or separately from, other surfaces. As also hereinbefore mentioned, the color map memory 10 is loaded appropriately so that the pixel words read from pixel bit map memory 18 cause one or more surfaces to be displayed at a time.

When it is desired to input information into the pixel bit map memory 18, it is generally desired to write to a particular surface which, as indicated with reference to FIG. 1, means to any one or more of the pixel word bits stored at various addressable locations in memory 18. However, the input pixel word received from the processor data bus by way of multiplexer 44 is always based as through it was going to be written into the same order of bits in bit map memory 18, i.e. so that the lowest order bit from multiplexer 44 writes to the lowest order bit of a pixel address in memory 18, etc. This arrangement would be satisfactory if there were no designation of separate surfaces. In that case each input word would provide the "index" or color identifier for the pixel, and the four bit word or index would have the possibility of describing sixteen different colors.

However, the incoming data from multiplexer 44 may, for example, comprise an index for the higher order two bits in a location in memory 18, or the lower order two bits as in the case of the example depicted in FIG. 1. Nevertheless, the index, for whatever surface, will still be based with the lowest order bit thereof on the lowest order multiplexer 44 output lead, etc.

According to the present invention, this data is shifted in bit position by shift means 46 so that the data may be rapidly written to the proper surface in pixel bit map memory 18, without requiring the continual shifting of data in the processor. The extent of the shift is determined by input 48 to the shift means, in response to the status of the processer software indicative of the current surface being dealt with. The output word from shift means 46 may be passed through ALU means 50 without alteration for writing in memory 18 via multiplexer 52. However, in general, the ALU 50 executes a write protect operation as hereinafter more fully described so that the incoming data word or index is written only to the proper surface in memory 18 without altering the pixel data for other surfaces.

Figure 6:
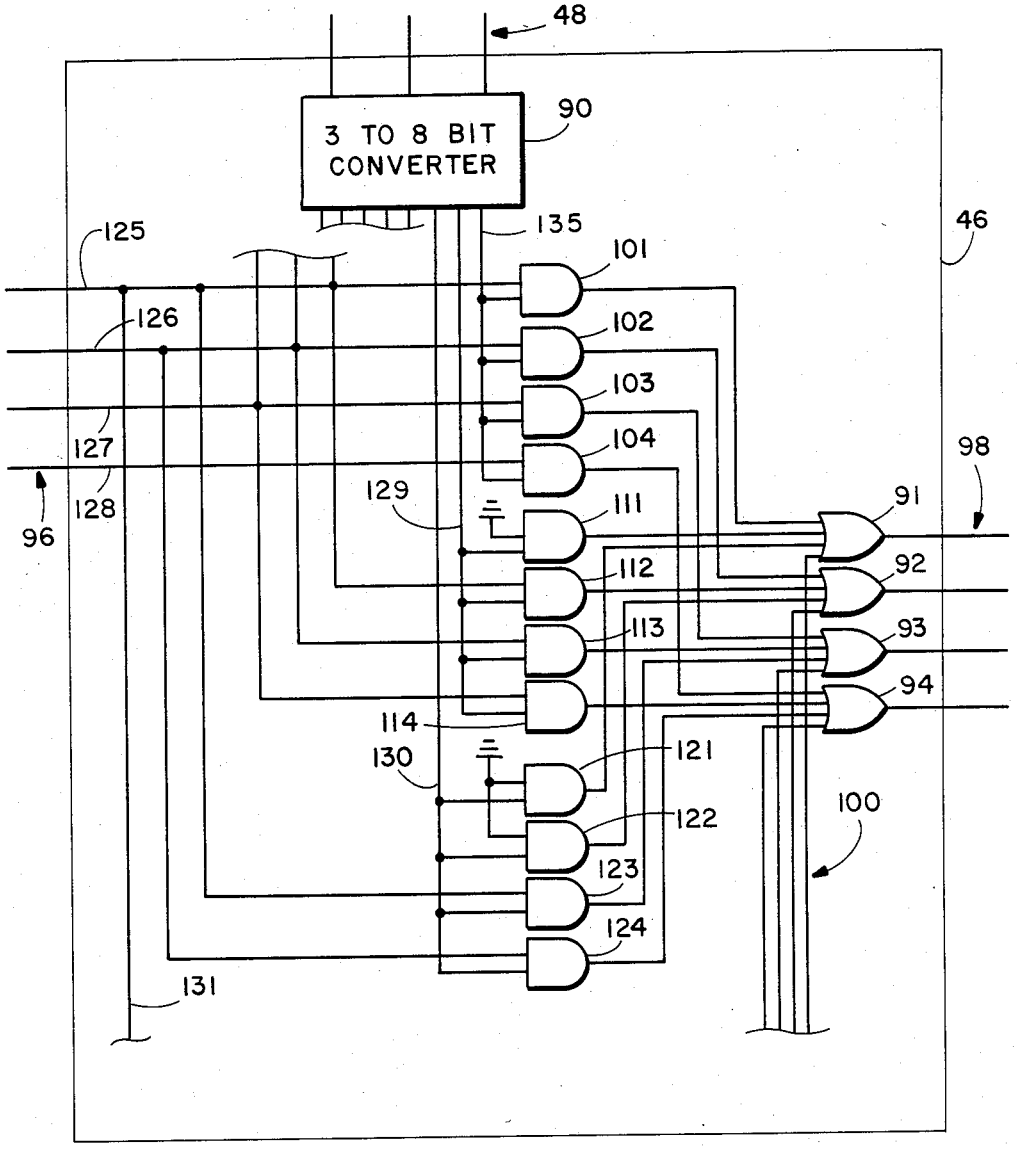

One example of a shifting means 46 is illustrated in greater detail in FIG. 6 wherein four input leads 96 are provided from multiplexer 44 and four output leads 98 are provided for input to ALU 60 from four OR gates 91–94. A three-to-eight bit converter 90 receives a three bit binary coded input on leads 48 from the processor and provides individual outputs for enabling groups of AND gates. A first group of AND gates 101–104 receives the input word or index on leads 96 and connects these leads directly to OR gates 91–94 such that no relative shift takes place between the input word and the output word. A second group of AND gates 111–114 also provides inputs to OR gates 91–94 respectively, but the inputs to this group of AND gates are shifted one position to the left. Thus, the input to AND gate 112 is connected to input lead 125, the input to AND gate 113 is connected to input lead 126, and the input to AND gate 114 is connected to input lead 127, while the input to AND gate 111 is grounded.

A third group of AND gates 121–124 provides additional inputs to OR gates 91–94 respectively, but the inputs to the latter group of AND gates is shifted two bit positions to the left. Thus, the input to AND gate 123 is connected to input lead 125, the input to AND gate 124 is connected to input lead 126, and the inputs of AND gates 121 and 122 are grounded.

Enabling inputs for the respective groups of AND gates 101–104, 112–114, and 121–124 are provided by selectively energizable outputs 135, 129 and 130 supplied from converter 90. When enabling lead 135 is energized, no shift takes place for the data on leads 98 relative to the input data on leads 96. When lead 129 is energized, the output data on leads 98 is shifted one bit position to the left, while when lead 130 is energized, the data on output leads 98 is shifted two places to the left. As indicated by broken leads 100 and 131, the structure of means 46 is shown only in part, and by an additional group of AND gates an additional left shifting operation (by three places) is carried out. Furthermore, the gating structure may be expanded to right-shift the input data in response to the energization of further appropriately connected AND gate groups by converter 90. Thus, any degree of shifting is easily achieved and is maintained as long as the processor is to communicate with a particular surface stored in memory 18. The shifting means 46 is suitably implemented by a correspondingly configured type 20R4 "PAL" manufactured by Monolithic Memories, Inc.

When a particular surface has been selected for receiving an input index or data word, the bits in pixel bit map memory 18 that aren't in the current surface are suitably protected so that writing of data into the selected surface won't affect the nonselected surface or surfaces. Consequently, the writing of new information from the processor into memory 18 takes place in a read-modify-write sequence as indicated at the right in FIG. 8. If the information in memory 18 is to be write protected, except for the surface written to, corresponding bits on write protect leads 132 are turned on by the processor. Thus, if surface 0 is to be written to, and corresponds to the two lower order bits, while surface 1 is to be write protected and corresponds to the two higher order bits, then the two higher order leads 132 will be true and the two lower order bits will be false. As a consequence of any of the leads 132 being true, a modify signal is provided by ALU 134 in conventional gating fashion to bring about the read-modify-write cycle.

Figure 7:
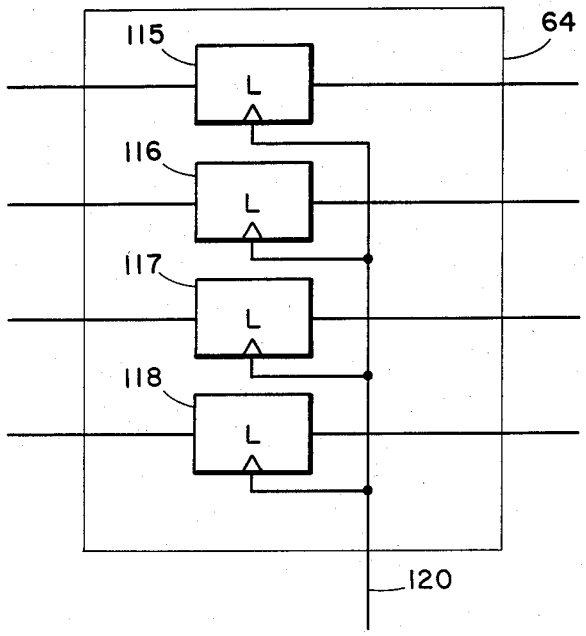

During the read cycle 82, the four bit pixel word from a particular location in memory 18 (to which it is desired to write) is read into the latches 115–118 of storage means 64 in FIG. 7, in response to a latch signal provided on lead 120. As the "old" data word is held in latches 115–118, screen cycle 84 takes place as hereinbefore discussed.

With the two higher order bits on leads 132 being true, the two higher order bit outputs from storage means 64, i.e. from latches 117 and 118, will be delivered to multiplexer 52 in place of any of the "new" data from shift means 46. On the other hand, the two lower order bits from the "new" data will be gated to multiplexer 52 for writing to the selected surface. Consequently, the incoming index is written to the proper surface, and the rest of the information in memory 18 is protected. It should be noted that any ALU operation can be performed by ALU 50 on any of the data received from shifting means 46 and the output is then supplied to multiplexer 52, except for those bits that are write protected. However, the function of greatest interest in reference to the present invention is the writing of information from the processor to the pixel bit map memory at the proper surface location wherein the write protect function of ALU 50 is principally employed.

Although the previous description has been concerned with writing new or replacement information in pixel bit map memory 18, it will be apparent that pixel information from one "surface" may be written to another "surface". Thus, information pertaining to a particular surface in bit map memory 18 may be read into the processor by a read cycle 78. Then, the information is treated as new information and is written through multiplexer 44 to the desired surface employing shifting means 46.

As can thus been seen, the apparatus of the present invention speeds graphics operations relative to dividing up input information into surfaces without requiring constant shifting of data by the processor itself.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A graphics display apparatus for producing a plurality of display images individually or in superimposed relation, including memory means for storing plural pixel maps wherein corresponding pixel locations in each map may be collectively employed to define a pixel on the display, said memory means being divisible into groups each storing a pixel map corresponding to an image to be displayed, comprising:

means for receiving common based input information in the form of one or more parallel bits comprising a location index to the memory means of a selected pixel map to enable writing to corresponding pixel locations in one or more pixel maps in said memory means;

and means for shifting the bits of said input information to write to a memory means group storing the pixel maps corresponding to an image to which it is desired to provide input information, wherein said means for shifting includes a gating structure for receiving the parallel bits of said input information, with the gating structure having:

selectively enabled groups of a first type of gates each receiving the parallel bits of said input information in successively displaced bit location;

means for combining corresponding output signals of said groups of the first type of gates; and means for enabling a selected group of the first types of gates, according to the bit displacement desired for shifting, for writing to corresponding pixel locations in a group of memory means storing the pixel map corresponding to an image to which it is desired to provide input information.

2. The apparatus according to claim 1 including means for disabling writing of input information to groups of the memory means having stored therein one or more pixel maps corresponding to an image or images it is not desired to change.

3. The apparatus according to claim 2 wherein said means for disabling comprises means for reading information from a region of memory it is not desired to change, and means for reading the last mentioned information back into the last mentioned region in place of shifted information.

4. The apparatus according to claim 1 further including an arithmetic logic unit interposed between said means for shifting and said memory means, said arithmetic logic unit also receiving information previously stored in said memory means, as well as input information, for selectively producing the logical combination of stored information and input information for re-entry into said memory means.

5. The apparatus according to claim 1 wherein said memory means comprises a plurality of random access memories each capable of storing a portion of the pixel information for display, shift register means for supplying display information seriatim, and means for reading said plurality of random access memories in parallel for input to said shift register means.

6. The apparatus according to claim 1 wherein:

said first type of gates are AND gates; and said combining means ORs together the output signals from the grouped gates.

* * * * *